US007140359B2

(12) United States Patent
Cheng

(10) Patent No.: US 7,140,359 B2
(45) Date of Patent: Nov. 28, 2006

(54) SPARK PLUG CAPABLE OF REMOVING REMAINING ELECTRIC CHARGES

(76) Inventor: David Cheng, P.O. Box 26-757, Taipei 106 (TW)

( * ) Notice: Subject to any disclaimer, the term of this patent is extended or adjusted under 35 U.S.C. 154(b) by 122 days.

(21) Appl. No.: 11/042,905

(22) Filed: Jan. 26, 2005

(65) Prior Publication Data

US 2006/0162685 A1 Jul. 27, 2006

(51) Int. Cl.
*H01T 13/32* (2006.01)

(52) U.S. Cl. ..... 123/608; 123/169 PA; 123/630; 123/645; 313/128

(58) Field of Classification Search ..... 123/169 PA, 123/608, 630, 645; 313/123
See application file for complete search history.

(56) References Cited

U.S. PATENT DOCUMENTS 1,441,397 A * 1/1923 Chard et al. ..... 313/128
1,542,825 A * 6/1925 Newton ..... 313/128
1,965,534 A * 7/1934 Nowosielski ..... 313/128
2,099,737 A * 11/1937 Hopkins ..... 313/128
2,111,188 A * 3/1938 Kostyk et al. ..... 313/128

* cited by examiner

*Primary Examiner*—Erick R. Solis
(74) *Attorney, Agent, or Firm*—Rosenberg, Klein & Lee

(57) ABSTRACT

A spark plug capable of removing the remaining electric charges is proposed. The spark plug can be installed in a vehicle and has an insulating body, a center electrode, a conductive housing and a conductive wire. The center electrode is passed through the insulating body. The conductive housing is disposed outside the insulating body. One end of the conductive wire is connected to the conductive housing and the other end of the conductive wire is fixed on a negative electrode of a battery of the vehicle. Since the electric charges remaining in the spark plug can be removed by the conductive wire after the high-voltage current sent from the ignition system induces the sparks, the present invention can avoid the damage of the spark plug to keep the spark plug in good status, maintain the efficiency of the engine, and make the car safer in usage.

7 Claims, 3 Drawing Sheets

SPARK PLUG CAPABLE OF REMOVING REMAINING ELECTRIC CHARGES

BACKGROUND OF THE INVENTION

1. Field of the Invention

The present invention is related to a spark plug, and more particularly, to a spark plug that is capable of removing the remaining electric charges thereof.

2. Description of Related Art

Conventionally, engines and ignition systems are used together to provide motive power for automobiles. An engine usually has several cylinders. Each of the cylinders has a cylinder head with a spark plug. Furthermore, an ignition system generally has a battery, an ignition switch, an ignition coil, a distributor and spark plug. When the ignition switch is turned on, the electric current first passes through the primary coil of the ignition coil. Then, the breaker point of the distributor is opened quickly to produce a high-voltage current via the electromagnetic effect and the high-voltage current is delivered to a high-voltage input end of the distributor via a secondary coil of the ignition coil. Finally, the distributor passes the high-voltage current to the spark plugs one by one via its high-voltage output ends to drive the spark plugs to produce sparks and thereby ignite the blended gas inside the cylinders to provide the power of the engine.

A conventional spark plug includes an insulating body, a center electrode and a conductive housing having a side electrode. The center electrode and side electrode of the spark plug are generally positioned inside a combustion chamber of a cylinder. When the ignition system passes the high-voltage current to the center electrode of the spark plug to produce a spark, some electric charges may remain in the side electrode of the conductive housing. It not only affects the usage of the spark plug and the efficiency of the engine but also possibly produces small sparks to cause unexpected damage.

SUMMARY OF THE INVENTION

An objective of the present invention is to provide a spark plug capable of removing the remaining electric charges. In the present invention, the electric charges remaining in the spark plug can be removed by a conductive wire after a high-voltage current sent from the ignition system induces the sparks. Hence, the present invention can keep the spark plug in good status, maintain the efficiency of the engine, and make the car safer in usage.

For achieving the objective above, the present invention provides a spark plug capable of removing the remaining electric charges. The spark plug can be disposed on a vehicle and has an insulating body, a center electrode, a conductive housing and a conductive wire. The center electrode is passed through the insulating body. The conductive housing is disposed outside the insulating body. One end of the conductive wire is connected to the conductive housing and the other end is fixed on a negative electrode of a battery of the vehicle.

Since the conductive wire connects the conductive housing to the negative electrode of the battery of the vehicle, the electric charges remaining in the spark plug can be removed by the conductive wire after the high-voltage current sent from the ignition system induces the sparks. Thus, the present invention can keep the spark plug in good status, maintain the efficiency of the engine, and make the car safer in usage.

Numerous additional features, benefits and details of the present invention are described in the detailed description, which follows.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF PREFERRED EMBODIMENTS

Figure 1:
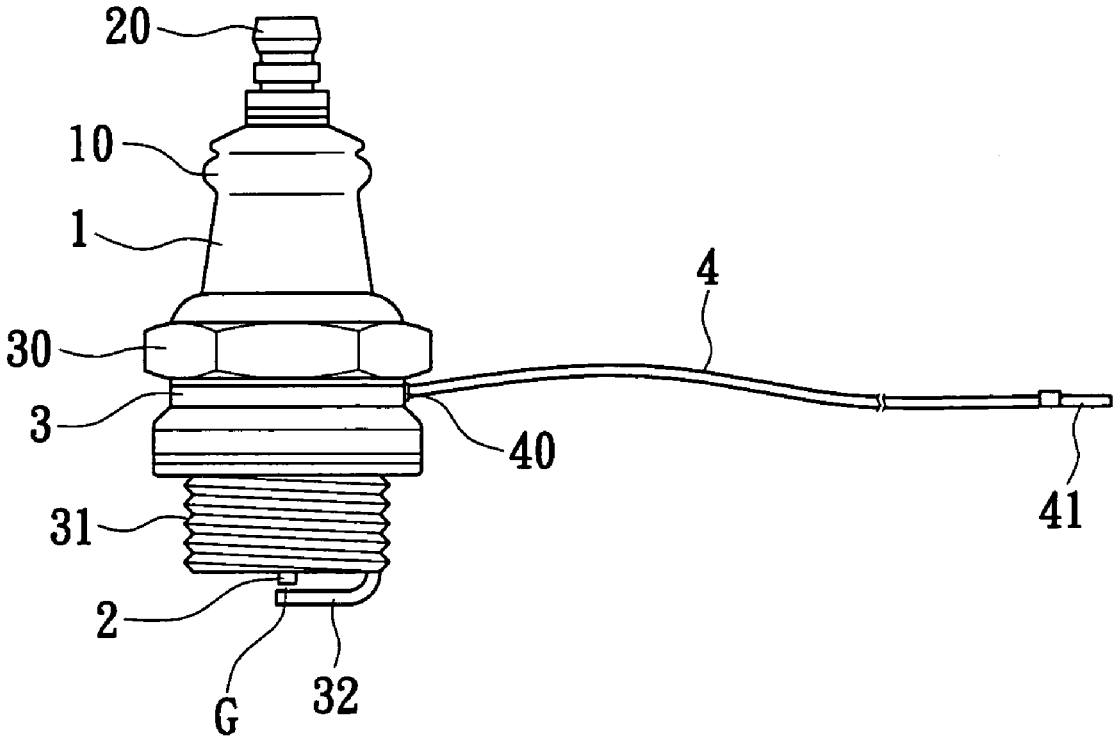
FIG. 1 is a schematic diagram of a spark plug capable of removing the remaining electric charges in accordance with the present invention.
Figure 2:
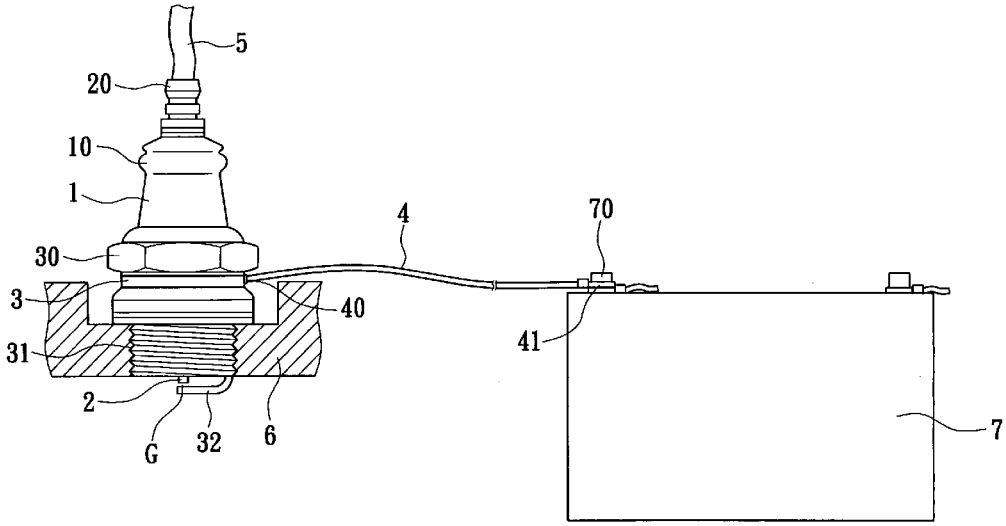
FIG. 2 is a schematic diagram of a spark plug using a conductive wire to connect with a negative electrode of a car's battery in accordance with the present invention.

Reference is made to FIGS. 1 and 2. The present invention provides a spark plug capable of removing the remaining electric charges. It is disposed on a car and includes an insulating body 1, a center electrode 2, a conductive housing 3 and a conductive wire 4. The insulating body 1 can be made of rigid porcelain. It can resist high temperature and high pressure and has a good isolation property. The insulating body has several rids 10 to improve the isolation property and dissipate heat from the spark plug.

The center electrode 2 can be made of nickel, nickel alloy or platinum alloy. It can resist high temperature and have good conductivity. The center electrode 2 passes through the insulating body 1. The upper end of the center electrode 2 has a connector 20 arranged above the upper end of the insulating body 1 to connect with a high-voltage electric wire 5.

The conductive housing 3 can be made of steel alloy. It is disposed outside the insulating body 1. One end of the conductive housing 3 is formed with a hexagonal nut 30 and the other end is formed with a thread 31. The nut 30 makes the spark plug easy to install or remove. The thread 31 makes the spark plug easy to install in a cylinder head 6 of an engine. A side electrode 32 is disposed below the thread 31 of the conductive housing 3 and a spark plug gap G is formed between the center electrode 2 and the side electrode 32.

The conductive wire 4 is a metal wire. One end of the conductive wire 4 is connected to the conductive housing 3 and the other end is fixed on a negative electrode 70 of a car's battery 7. As shown in FIG. 2, in this embodiment, the conductive wire 4 has a welding body 40 and a connecting end 41. The welding body 40 is welded on the conductive housing 3 and the connecting end 41 is fixed on the negative electrode 70 of the battery 7.

In the present invention, the spark plug capable of removing the remaining electric charges is installed in a vehicle, such as a car. The power of the car is provided by its engine together with an ignition system. The engine has several cylinders and each of them has a spark plug, such as the spark plug of the present invention. Reference is made to FIG. 2, in which the end of the spark plug with the thread 31 are attached to the cylinder head 6. The center electrode 2 and the side electrode 32 of the conductive housing 3 are positioned inside the combustion chamber of the cylinder. The ignition system of the car includes a battery (such as the battery 7 shown in FIG. 2), an ignition switch, an ignition coil, a distributor and spark plug. The ignition switch is electrically connected between the positive electrode of the battery and the primary coil of the ignition coil. The secondary coil of the ignition coil is connected to the high-voltage input end of the distributor via a high-voltage electric wire. The high-voltage output end of the distributor is also connected to the spark plug via a high-voltage electric wire (such as the high-voltage electric wire 5 shown in FIG. 2). The ignition coil has a connecting wire to connect electrically a capacitor with a breaker point of the distributor. When the ignition switch is turned on, the electric current is passed to the primary coil of the ignition coil. Then, the breaker point of the distributor is opened quickly to produce a high-voltage current via the electromagnetic effect and the high-voltage current is passed to the high-voltage input end of the distributor via the secondary coil of the ignition coil. After that, the distributor delivers the high-voltage current to the center electrode 2 of the spark plug via its high-voltage output end. In this way, the high-voltage current can make sparks occur between the center electrode 2 and the side electrode 32 to ignite the blended gas inside the cylinder. Finally, the blended gas is rapidly expanded to push a plunger of the cylinder to provide the power of the engine.

Figure 3:
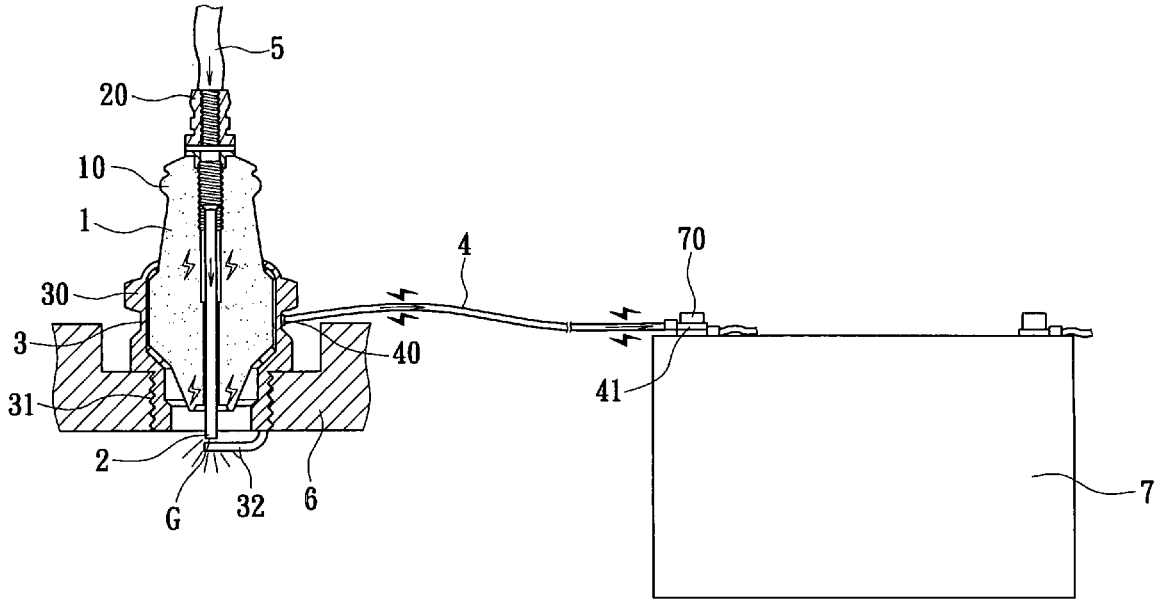
FIG. 3 is a cross-sectional view of a spark plug using the conductive wire to connect with the negative electrode of the battery in accordance with the present invention.

Reference is made to FIG. 3. Since the conductive wire 4 connects the conductive housing 3 to the negative electrode 70 of the car's battery 7, the electric charges remaining in the spark plug can be removed by the conductive wire 4 after the high-voltage current sent from the ignition system induces the sparks. Thus, the side electrode 32 does not have remaining electric charges. Hence, the present invention can avoid damage to the spark plug or electric strokes to keep the spark plug in good status and maintain the efficiency of the engine. Furthermore, since the side electrode 32 does not have the remaining electric charges, the present invention can prevent the side electrode 32 from producing small sparks. Hence, the present invention can make the car safer in usage.

Summing up, the spark plug capable of removing the remaining electric charges in accordance with the present invention has the features as follows:

(1) The spark plug of the present invention has a conductive wire to connect electrically the conductive housing to the negative electrode of the car's battery. Hence, after the high-voltage current sent from the ignition system makes the spark plug produce sparks, the electric charges remaining in the spark plug can be removed via the conductive wire. Thus, the present invention can avoid the damage of the spark plug to keep the spark plug in good status and maintain the efficiency of the engine.

(2) Since the electric charges remaining in the spark plug can be removed by the conductive wire after the high-voltage current sent from the ignition system induces the sparks, the present invention can make the car safer in usage.

Although the present invention has been described with reference to the preferred embodiment thereof, it, will be understood that the invention is not limited to the details thereof. Various substitutions and modifications have been suggested in the foregoing description, and other will occur to those of ordinary skill in the art. Therefore, all such substitutions and modifications are embraced within the scope of the invention as defined in the appended claims.

What is claimed is:

1. A spark plug capable of removing remaining electric charges, the spark plug being installed in a vehicle, the spark plug comprising:

an insulating body;

a center electrode passing through the insulating body;

a conductive housing disposed outside the insulating body; and a conductive wire, one end of the conductive wire being connected to the conductive housing and another end of the conductive wire being fixed on a negative electrode of a battery of the vehicle.

2. The spark plug as claimed in claim 1, wherein the conductive wire has a welding body welded on the conductive housing.

3. The spark plug as claimed in claim 1, wherein the conductive wire has a connective end fixed on the negative electrode of the battery of the vehicle.

4. The spark plug as claimed in claim 1, wherein the conductive housing has one end formed with a nut and another end formed with a thread.

5. The spark plug as claimed in claim 1, wherein the conductive housing has a side electrode.

6. The spark plug as claimed in claim 1, wherein the center electrode has an upper end with a connector positioned above an upper end of the insulating body.

7. The spark plug as claimed in claim 1, wherein the insulating body has a plurality of ribs.

* * * * *